US010343080B2

(12) United States Patent
Jang

(10) Patent No.: US 10,343,080 B2
(45) Date of Patent: Jul. 9, 2019

(54) ASSEMBLING TOY BLOCK

(71) Applicant: CREVEL KOREA CO., LTD., Busan (KR)

(72) Inventor: Moonsuck Jang, Busan (KR)

(73) Assignee: CREVEL KOREA CO., LTD. (KR)

( * ) Notice: Subject to any disclaimer, the term of this patent is extended or adjusted under 35 U.S.C. 154(b) by 0 days.

(21) Appl. No.: 15/950,758

(22) Filed: Apr. 11, 2018

(65) Prior Publication Data

US 2018/0229146 A1 Aug. 16, 2018

Related U.S. Application Data

(63) Continuation of application No. PCT/KR2016/009151, filed on Aug. 19, 2016.

(30) Foreign Application Priority Data

Oct. 12, 2015 (KR) ..... 10-2015-0141947

(51) Int. Cl.
*A63H 33/04* (2006.01)
*A63H 33/08* (2006.01)
*A63H 33/06* (2006.01)

(52) U.S. Cl.
CPC ..... *A63H 33/086* (2013.01); *A63H 33/06* (2013.01); *A63H 33/08* (2013.01)

(58) Field of Classification Search
CPC ..... A63H 33/04; A63H 33/08; A63H 33/086
USPC ..... 446/85, 105, 107, 109, 111, 116, 119, 446/120, 122, 124, 128
See application file for complete search history.

(56) References Cited

U.S. PATENT DOCUMENTS 4,792,319 A * 12/1988 Svagerko ..... A63H 33/08 446/104
4,886,477 A * 12/1989 Ziegler ..... A63H 33/065 446/104
5,310,376 A * 5/1994 Mayuzumi ..... A63H 33/04 446/107
5,498,190 A * 3/1996 Ganson ..... A63H 33/04 446/107

(Continued)

FOREIGN PATENT DOCUMENTS

JP 09-024165 A 1/1997
JP 2002-521161 A 7/2002

(Continued)

OTHER PUBLICATIONS

International Search Report (PCT/KR2016/009151), WIPO, dated Dec. 5, 2016.

(Continued)

*Primary Examiner* — Alexander R Niconovich
(74) *Attorney, Agent, or Firm* — Park & Associates IP Law, P.C.

(57) ABSTRACT

The present invention relates to an assembling toy block structure that is capable of easily performing a releasing operation for toy blocks coupled to each other with a relatively small force. The assembling toy block structure includes at least one or more polyhedron-shaped toy blocks assembled to each other to make a desired toy form and further includes generally cable-shaped clay blocks made of a material having flexibility with which they are freely bent and rigidity with which they are resistant to external forces after bent.

2 Claims, 12 Drawing Sheets

(56) References Cited

U.S. PATENT DOCUMENTS

| | | | | | |
|---|---|---|---|---|---|
| 5,938,497 | A * | 8/1999 | Mott | A63H 33/10 | 446/122 |
| 6,186,855 | B1 * | 2/2001 | Bauer | A63H 33/04 | 446/104 |
| 6,461,215 | B1 * | 10/2002 | Kunz | A63H 33/042 | 446/102 |
| 6,648,715 | B2 * | 11/2003 | Wiens | A63H 33/062 | 446/121 |
| 6,682,385 | B2 * | 1/2004 | Atzen | A63H 33/088 | 273/156 |
| 7,364,487 | B2 * | 4/2008 | Evans | A63H 33/008 | 446/108 |
| 7,547,020 | B1 * | 6/2009 | Kohavi | A63H 33/042 | 273/153 S |
| 7,648,407 | B1 * | 1/2010 | Sorensen | A63H 33/084 | 446/120 |
| 7,736,211 | B2 * | 6/2010 | Marzetta | A63H 33/106 | 446/113 |
| 8,366,507 | B2 * | 2/2013 | Chen | A63H 33/086 | 446/108 |
| 8,403,723 | B1 * | 3/2013 | Haner | A63H 33/08 | 446/120 |
| 8,459,410 | B2 * | 6/2013 | Parvizian | A47C 12/00 | 182/178.5 |
| 8,961,259 | B2 * | 2/2015 | Maggiore | A63H 33/062 | 446/120 |
| 9,308,464 | B1 * | 4/2016 | Torres | A63H 33/044 | |
| 9,345,982 | B2 * | 5/2016 | Farco | A63H 33/10 | |
| 9,409,099 | B2 * | 8/2016 | Sokolov | A63H 33/08 | |
| 9,454,916 | B2 * | 9/2016 | Kelly | G09B 23/02 | |
| 9,643,101 | B2 * | 5/2017 | Acerra | A63H 33/084 | |
| 9,839,860 | B2 * | 12/2017 | Rakhsha | A63H 33/04 | |
| 2007/0178799 | A1 * | 8/2007 | Rudell | A63H 33/101 | 446/120 |

FOREIGN PATENT DOCUMENTS

| | | | |
|---|---|---|---|
| KR | 20-0218830 | Y1 | 4/2001 |
| KR | 10-2007-0076413 | A | 7/2007 |
| KR | 10-2013-0057531 | A | 6/2013 |
| KR | 10-1521194 | B1 | 5/2015 |
| KR | 10-2015-0088143 | A | 7/2015 |

OTHER PUBLICATIONS

Korean Office Action (KR 10-2015-0141947), KIPO, Mar. 27, 2017.

Korean Office Action (KR 10-2015-0141947), KIPO, Dec. 28, 2017.

Korean Decision to Grant (KR 10-2015-0141947), KIPO, Aug. 30, 2018.

* cited by examiner

ASSEMBLING TOY BLOCK

REFERENCE TO RELATED APPLICATIONS

This is a continuation of pending International Patent Application PCT/KR2016/009151 filed on Aug. 19, 2016, which designates the United States and claims priority of Korean Patent Application No. 10-2015-0141947 filed on Oct. 12, 2015, the entire contents of which are incorporated herein by reference.

FIELD OF THE INVENTION

The present invention relates to an assembling toy block structure, and more particularly, to an assembling toy block structure that is capable of producing various solid effects through clay blocks having both of flexibility and rigidity and easily performing a releasing operation for toy blocks coupled to each other with a relatively small force.

BACKGROUND OF THE INVENTION

Generally, a toy block, which includes a plurality of assembling bodies having various solid forms such as rectangular parallelepiped, cylinder and so on, builds various structures through the assembling bodies coupled to each other, thereby providing a lot of educational effects for children who perform the assembling operations and also improving the children's intelligence and creativity through the production of various models.

In this case, generally, the toy block includes cylindrical block bodies open on one side thereof and having a plurality of coupling protrusions protruding from the surface corresponding to the open surface of another block body. The block bodies have various sizes and colors, and they are freely coupled to one another so as to build desired forms. Accordingly, the toy block has been widely used as play for developing creativity of babies or children.

On the other hand, a conventional representative technology related to the toy block is disclosed in Korean patent registration No. 10-1521194 (entitled 'assembling toy block', which is hereinafter referred to as 'Prior art) filed on Nov. 20, 2013 and issued on May 12, 2015 to the same applicant as the invention.

According to the Prior art, the assembling toy block, which has a shape of a polyhedron, includes a plurality of top hollow cylindrical protrusions protruding from top of the polyhedron in such a manner as to be spaced apart from each other by a given distance and a plurality of bottom hollow cylindrical protrusions protruding from one side of bottom of the polyhedron in such a manner as to be tightly coupled to the plurality of top hollow cylindrical protrusions of another polyhedron. Further, the top hollow cylindrical protrusions and the bottom hollow cylindrical protrusions include contact reinforcement concave-convex portions each having a plurality of contact protrusions protruding from the inner peripheries thereof in such a manner as to be spaced apart from each other by a given distance, and joint units are fitted to the contact reinforcement concave-convex portions in such a manner as to have contact reinforcement fixing portions adapted to allow the outer peripheries of the contact protrusions to be fixedly contacted with the inner peripheries of the hollow cylindrical protrusions.

According to the Prior art, the contact reinforcement fixing portions of the joint units are fitted to the contact reinforcement concave-convex portions formed in the grooves of the toy block, and if the joint units are coupled to the toy block, the rigidly coupled state is maintained. If it is desired that the joint units are separated from the toy block, however, a relatively strong force has to be required, which is disadvantageous to children who do not have enough force to separate them from each other.

In addition, even when the two toy blocks are assembled up and down to each other, they are coupled to each other by means of the contact reinforcement concave-convex portions and the contact reinforcement fixing portions, which also requires a relatively large force in separation of the two toy blocks coupled to each other.

According to the Prior art, moreover, a desired toy form is simply built only with the toy blocks, which is disadvantageous to producing various toy forms.

SUMMARY OF THE INVENTION

Accordingly, the present invention has been made in view of the above-mentioned problems occurring in the prior art, and it is an object of the present invention to provide an assembling toy block structure that has cable-shaped clay blocks made of a material having flexibility with which they are freely bent and rigidity with which they are resistant to external forces after bent, so that the clay blocks are coupled to toy blocks to produce various solid toy forms.

It is another object of the present invention to provide an assembling toy block structure that is capable of separating two or more toy blocks coupled horizontally to each other in left and right or front and back directions with a relatively small force.

It is yet another object of the present invention to provide an assembling toy block structure that is capable of separating two or more toy blocks coupled vertically up and down to each other with a relatively small force.

To accomplish the above objects, according to the present invention, there is provided an assembling toy block structure including at least one or more polyhedron-shaped toy blocks assembled to each other to make a desired toy form, wherein each toy block has fastening grooves formed on left and right sides thereof, each fastening groove being open on a top end thereof to form an opening.

According to the present invention, desirably, each toy block further includes side female coupling protrusions protruding from the fastening grooves and a front male coupling protrusion protruding from the front surface thereof.

According to the present invention, desirably, each toy block further includes locking protrusions protruding from four corners of top thereof.

According to the present invention, desirably, each toy block further includes at least one or more top female coupling protrusions protruding from top thereof.

According to the present invention, desirably, the assembling toy block structure further includes generally cable-shaped clay blocks made of a material having flexibility with which they are freely bent and rigidity with which they are resistant to external forces after bent in such a manner as to be coupled to the toy blocks.

According to the present invention, desirably, each clay block includes: a metal wire; a PVC coating material coated on the outer periphery of the metal wire; a cushion member covered along the outer periphery of the PVC coating material; and connection caps coupled to both ends of the cushion member to allow the clay block to be assembled to the toy block or another clay block.

According to the present invention, desirably, each clay block includes: a cushion member having a given length;

and connection caps coupled to both ends of the cushion member to allow the clay block to be assembled to the toy block or another clay block.

According to the present invention, the assembling toy block structure has the cable-shaped clay blocks made of a material having flexibility with which they are freely bent and rigidity with which they are resistant to external forces after bent, so that the clay blocks are coupled to the toy blocks to provide various solidity for the toy form built, thereby improving children's curiosity and imagination.

In addition, the assembling toy block structure according to the present invention allows top ends of the fastening grooves to be open to form the openings, so that as one toy block is lifted upwardly from the other toy block coupled thereto, the two toy blocks assembled horizontally to each other can be simply separated from each other with a relatively small force, thereby improving conveniences in use.

Further, the assembling toy block structure according to the present invention allows the two or more toy blocks coupled vertically up and down to each other to be easily separated from each other with a relatively small force.

DETAILED DESCRIPTION OF THE INVENTION

Hereinafter, an explanation on an assembling toy block structure according to the present invention will be in detail given with reference to the attached drawing.

Figure 1:
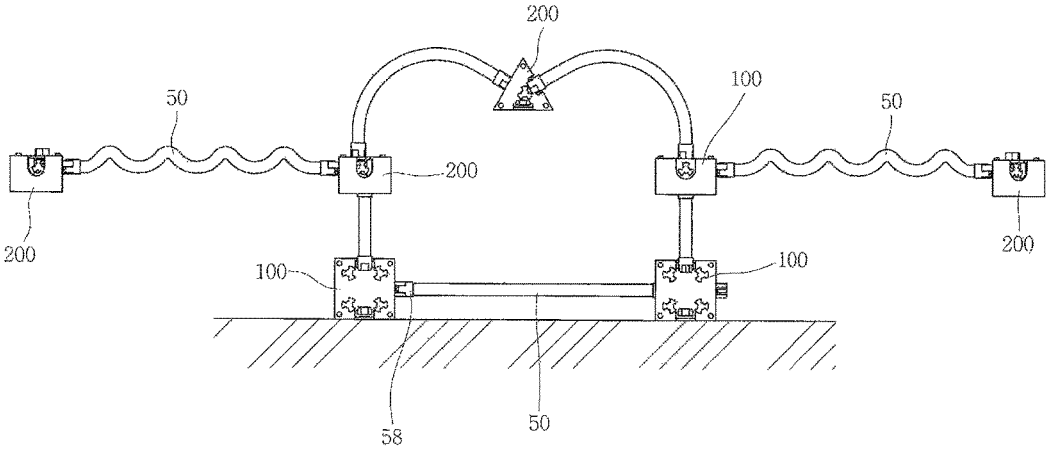
FIG. 1 is a front view showing a whole configuration of an assembling toy block structure according to an embodiment of the present invention.

FIG. 1 is a front view showing a whole configuration of an assembling toy block structure according to an embodiment of the present invention.

As shown in FIG. 1, an assembling toy block structure according to the present invention includes at least one or more polyhedral toy blocks 100 and cable-shaped clay blocks 50 made of a flexible material freely bendable.

Each toy block 100 is molded to various shapes such as a right triangle, a square, etc. on the plane thereof, and according to the present invention, for example, the toy block 100 has the shape of the square.

Figure 2:
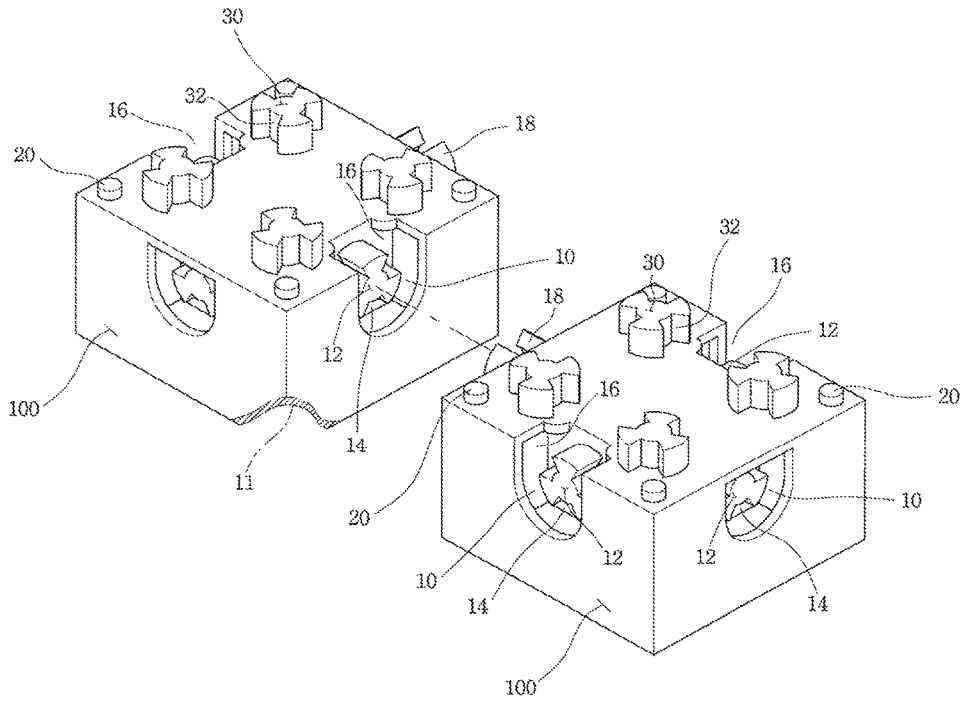
FIG. 2 is a perspective view showing a state where two toy blocks of FIG. 1 are coupled to each other in such a manner as to be located horizontally on left and right sides.

FIG. 2 is a perspective view showing a state where two toy blocks of FIG. 1 each having the shape of the square are coupled to each other in such a manner as to be located horizontally on left and right sides.

As shown in FIG. 2, the toy block 100 has the shape of the square on the plane thereof in such a manner as to be open on a bottom end thereof to form a space portion 11 therein.

The toy block 100 has fastening grooves 10 concavedly formed on at least one surface of left and right sides thereof and side female coupling protrusions 12 formed protrudingly from the fastening grooves 10.

Each side female coupling protrusion 12 has at least one or more insertion portions 14 concavedly formed along the outer periphery thereof, and according to the present invention, three insertion portions 14 are formed. A front male coupling protrusion 18 protruding from the front surface of another toy block 100 to be assembled to the toy block 100 in a horizontal direction on the left and right sides is inserted into the insertion portions 14 of the side female coupling protrusion 12 by means of forced fitting, so that the two toy blocks 100 are assembled to each other in the horizontal direction on the left and right sides.

Figure 3:
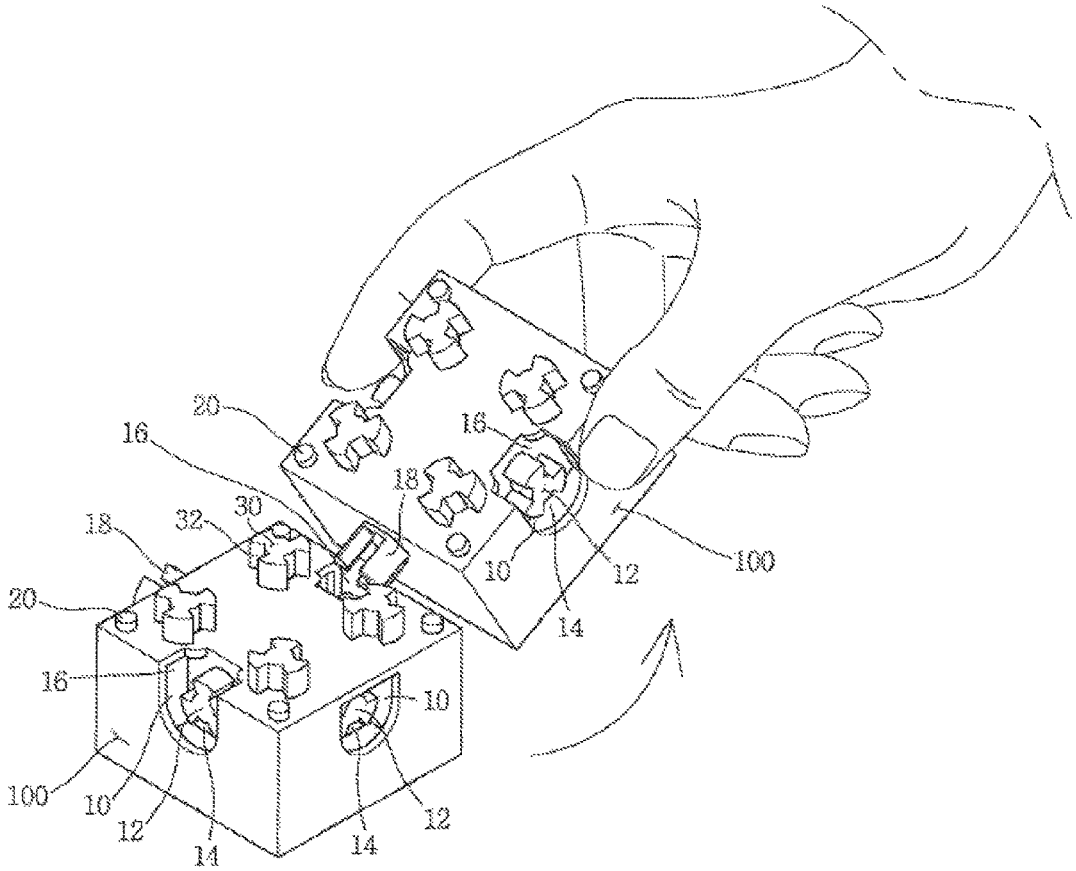
FIG. 3 is a perspective view showing a state where the two toy blocks of FIG. 1 are separated from each other.

Each fastening groove 10 of the toy block 100, in which the side female coupling protrusion 12 is formed, is incised on a top end thereof to form an opening 16, and as shown in FIG. 3, if the toy block 100 having the front male coupling protrusion 18 is lifted up to allow the front male coupling protrusion 18 of the opposite side toy block 100 to the toy block 100, which is inserted into the insertion portions 14 of the side female coupling protrusion 12, to be separated from the toy block 100, the front male coupling protrusion 18 is easily separated from the insertion portions 14 of the side female coupling protrusion 12 through the formation of the opening 16, so that the two toy blocks 100 assembled to each other can be easily separated from each other with a relatively small force.

In the conventional practice, the front male coupling protrusion 18 is inserted into the insertion portions 14 of the side female coupling protrusion 12 by means of forced fitting, and accordingly, it is hard that two toy blocks are separated from each other with a small force.

So as to solve the above-mentioned problems in the conventional practice, the assembling toy block structure according to the present invention is configured to have the front male coupling protrusion 18 inserted into the insertion portions 14 of the side female coupling protrusion 12 by means of forced fitting, so that the two toy blocks 100 assembled to each other are not easily separated from each other by means of a horizontally pulling force, and contrarily, the two toy blocks 100 are easily separated from each other by means of a vertically pushing force generated through the opening 16. Accordingly, the two toy blocks 100 can be easily separated from each other even by children who don't have enough force to separate them.

Figure 4:
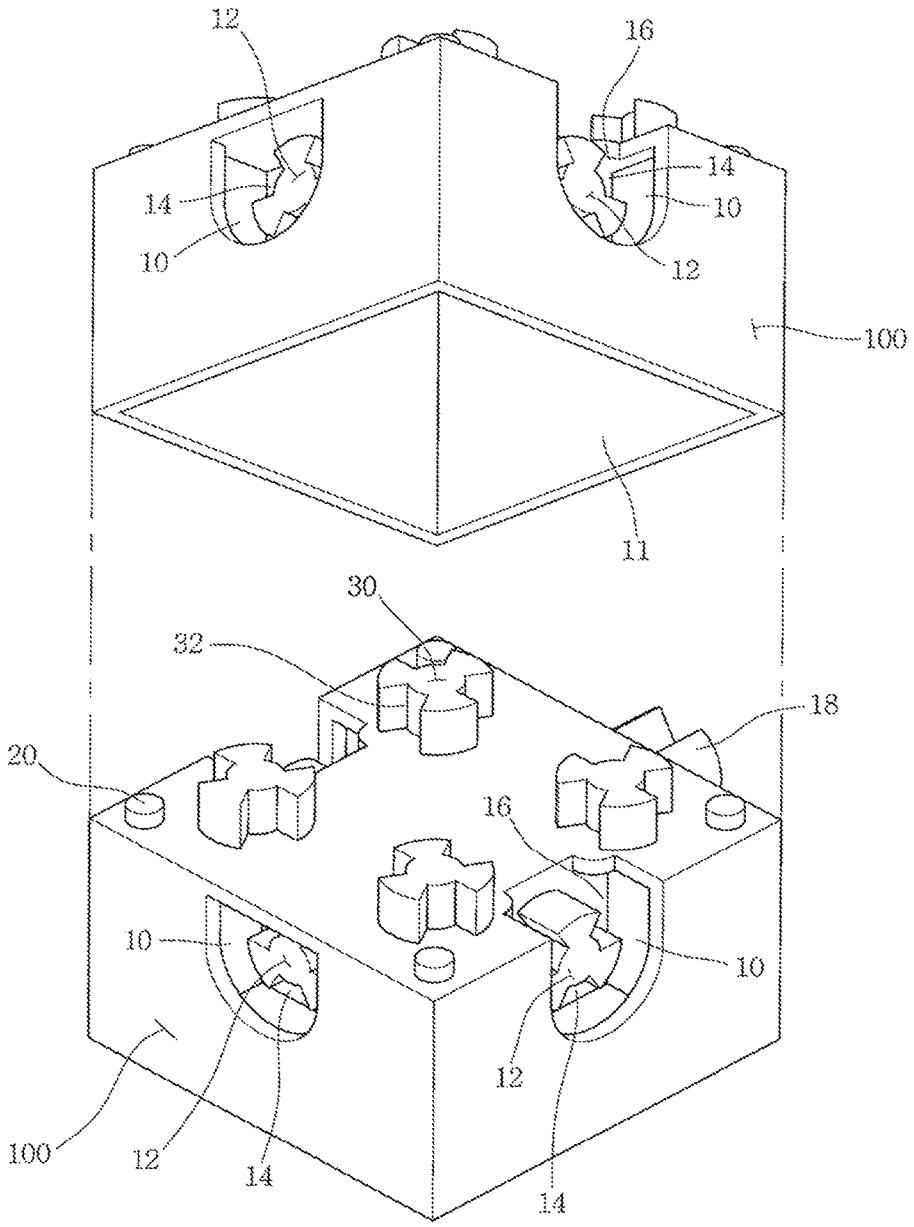
FIG. 4 is a perspective view showing a state where the two toy blocks of FIG. 1 are coupled to each other in such a manner as to be located vertically up and down.

The toy block 100 has locking protrusions 20 protruding from four corners on top thereof. When the two toy blocks 100 are assembled up and down to each other, as shown in FIG. 4, the locking protrusions 20 are locked onto inner corners of the open bottom of the toy block 100 located up, so that the two toy blocks 100 are fixedly assembled up and down to each other.

Further, the toy block 100 has top female coupling protrusions 30 protruding from top thereof. Each top female coupling protrusion 30 has at least one or more insertion portions 32 concavedly formed along the outer periphery thereof, and according to the present invention, three insertion portions 32 are concavedly formed. The front male coupling protrusion 18 of another toy block 100 or coupling protrusions 60 formed on connection caps 58 of each clay block 50 as will be discussed later is (are) assembled to the insertion portions 32 of each top female coupling protrusion 30, so that at least one or more clay blocks 50 are connected to the two toy blocks 100 or one toy block 100 to provide various toy forms.

The clay blocks 50 serve to assemble the toy blocks 100 to each other in up and down, left and right, and front and back directions and thus to provide various toy forms in a process where a toy as a finished product is made.

Figure 5:
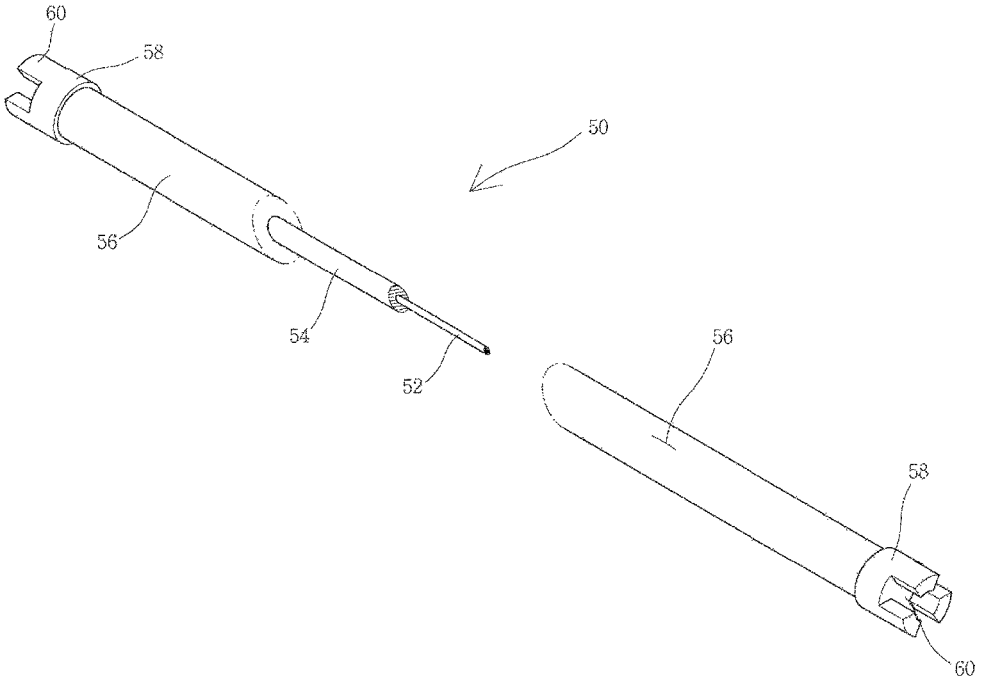
FIG. 5 is a perspective view showing a structure of a clay block of FIG. 1.

FIG. 5 is a perspective view showing a structure of the clay block of FIG. 1.

As shown in FIG. 5, each clay block 50 is molded to the shape of the cable and is made of a material having flexibility with which it is freely bent to a desired form and rigidity with which the bent state is kept to some extent, without easily bent by an external force, and accordingly, the clay block 50 can be bent to the desired form to provide various forms.

The clay block 50 includes a metal wire 52, a PVC coating material 54 coated on the outer periphery of the metal wire 52, a cushion member 56 covered along the outer periphery of the PVC coating material 54, and the connection caps 58 coupled to both ends of the cushion member 56 and having the coupling protrusions 60 protruding therefrom to allow the clay block 60 to be assembled to the toy block 10 or another clay block 50.

The metal wire 52 serves as means for providing the flexibility for the clay block 50, with which the clay block 50 is easily bent, and the rigidity for the clay block 50, with which the clay block 50 is kept in the state being bent, and desirably, the metal wire 52 is made of aluminum.

The PVC coating material 54 is made of a PVC material to completely cover and protect the metal wire 52 in such a manner as to be perfectly bonded to the outer periphery of the metal wire 52 through specific bonding, thereby enhancing durability thereof and especially preventing separation or disconnection from the connection caps 58.

The cushion member 56 is made of a silicone or resin material and is molded to a solid or foamed form. The solid form feels tight, tender, good at a restoring force, and easy to handle. The foamed form feels soft and good at cushion, so that it keeps various forms made by a user's hand and easily restores to its original shape. The cushion member 56 may be made to various thicknesses in accordance with ages and play levels.

Each connection cap 58 is moldedly made of an ABS material and has at least one or more coupling protrusions 60 protruding from the front outer periphery thereof in such a manner as to be spaced apart from each other by a given distance.

If it is desired that the clay block 50 is assembled to the toy block 100 or another clay block 50, the coupling protrusions 60 of the connection cap 58 are fittedly coupled to the insertion portions 14 or 32 of the side female coupling protrusion 12 or the top female coupling protrusion 30 of the toy block 100 or fittedly coupled to the coupling protrusions 60 formed on the connection cap 58 of another clay block 50 in a zigzag manner, so that the clay block 50 can be assembled to the toy block 100 or another clay block 50.

Figure 6:
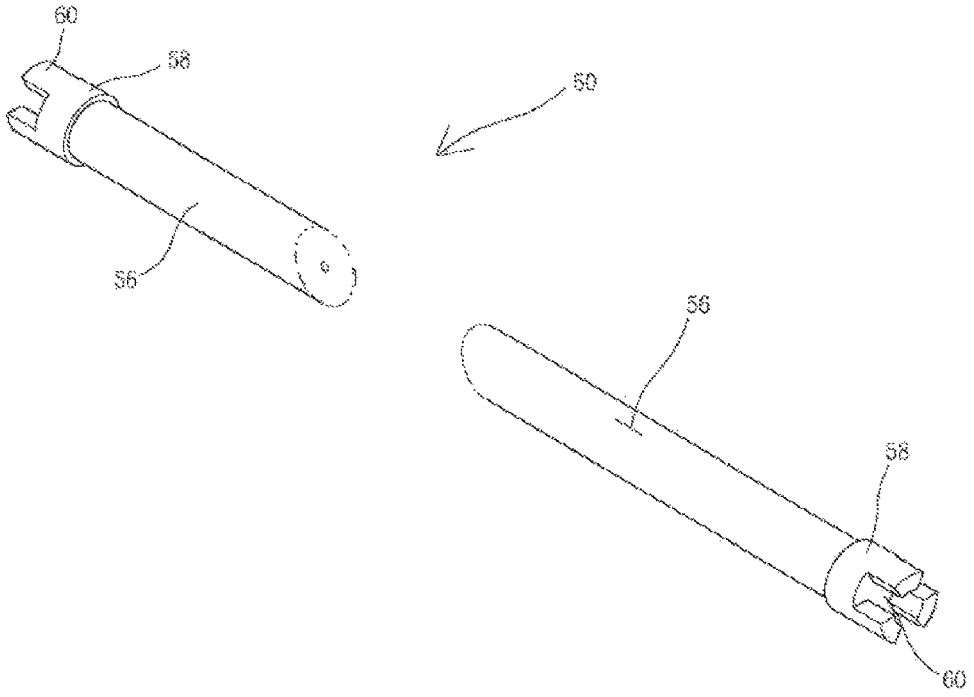
FIG. 6 is a perspective view showing another structure of the clay block of FIG. 1.

On the other hand, as shown in FIG. 6, the clay block 50 constitutes its outer form with the cushion member 56, without any the PVC coating material 54 and the metal wire 52, and further has the connection caps 58 located on both ends of the cushion member 56. At this time, the clay block 50 is flexible, but does not have any rigidity. After the clay block 50 is disassembled, however, it can be automatically returned to its original shape by means of the elastic force of the cushion member 56, thereby enhancing conveniences in use.

Figure 7:
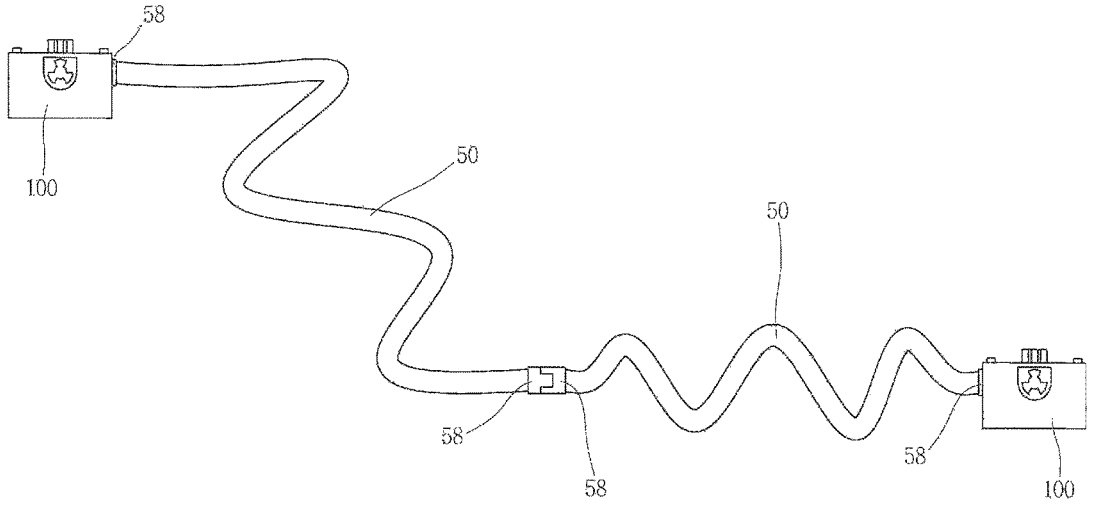
FIG. 7 is a perspective view showing an assembling state of the clay blocks of FIG. 5.
Figure 8:
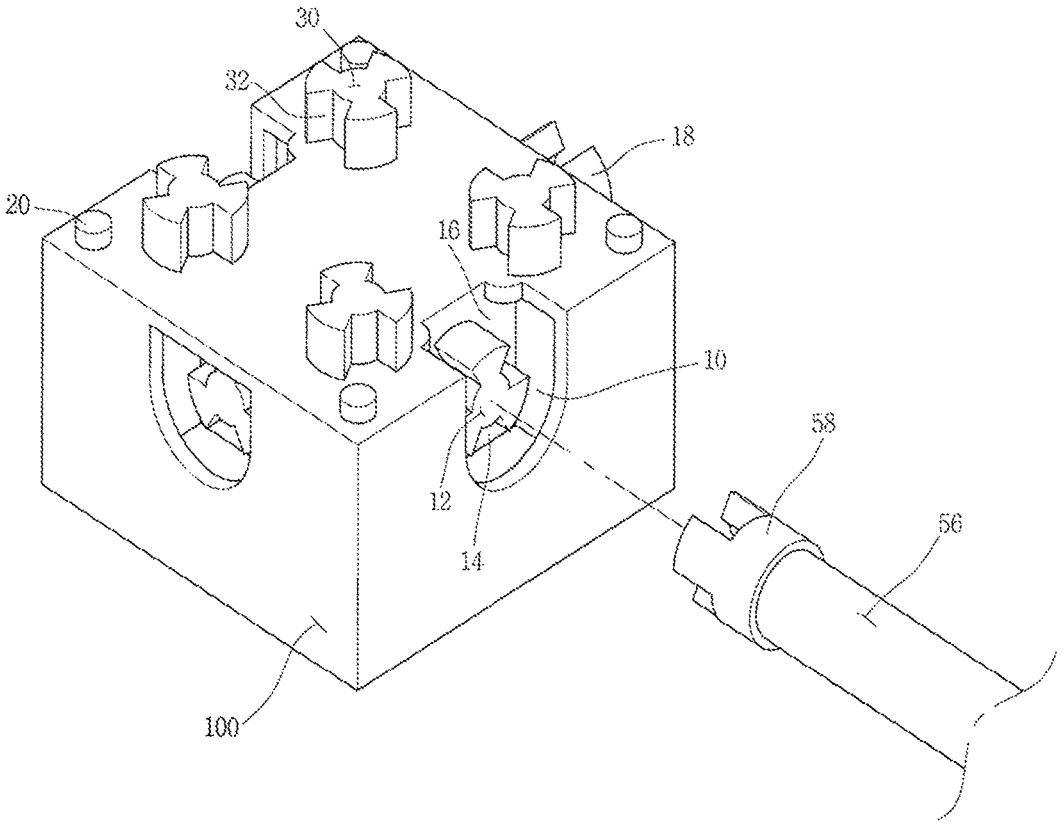
FIG. 8 is a perspective view showing an assembling state between the toy block and the clay block of FIG. 7.
Figure 9:
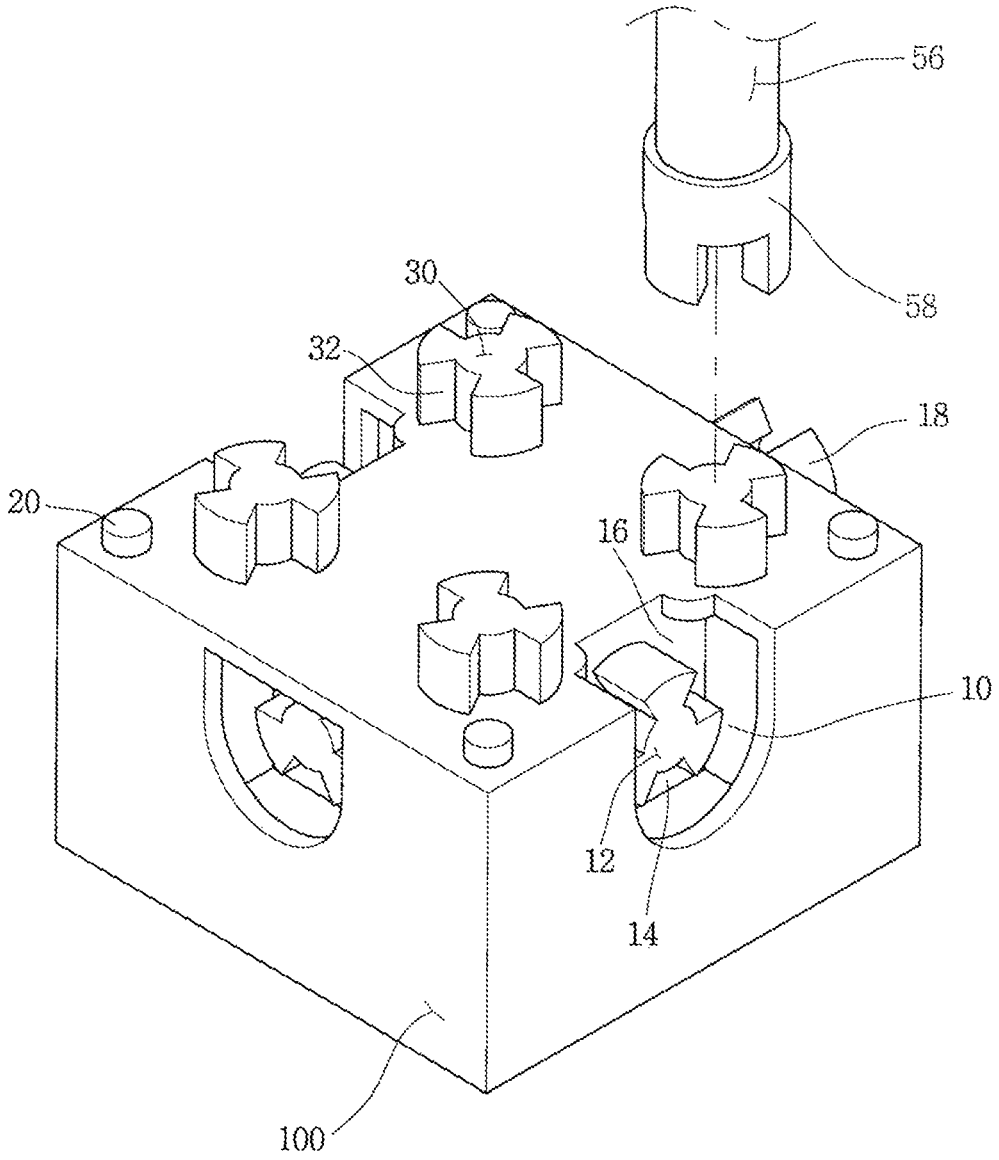
FIG. 9 is a perspective view showing another assembling state between the toy block and the clay block of FIG. 7.
Figure 10:
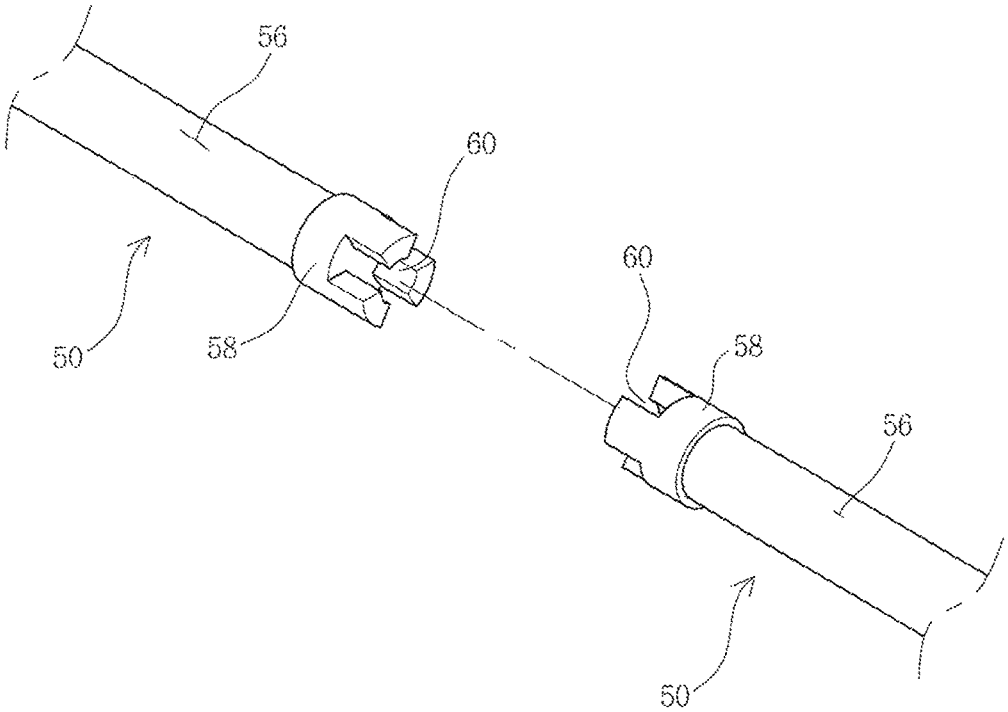
FIG. 10 is a perspective view showing an assembling state between the clay blocks of FIG. 7.

As shown in FIGS. 7 to 9, one side connection cap 58 of the clay block 50 is coupled to the side female coupling protrusion 12 or one top female coupling protrusion 30 of the toy block 100, thereby producing various forms, and if necessary, as shown in FIG. 10, one side connection cap 58 of the clay block 50 is coupled to the other side connection cap 58 of another clay block 50, thereby connecting the two clay blocks 50 to each other.

Now, an explanation on a method for assembling a desired toy using the assembling toy block structure according to the present invention will be given with reference to FIGS. 1 to 10.

If the desired toy form is determined, first, the toy blocks 100 are one by one assembled to each other in up and down, left and right, and front and back directions to make the desired toy form.

So as to assemble the two toy blocks 100 to each other on the left and right sides, first, the front male coupling protrusion 18 protruding from one side of one toy block 100 is forcedly fitted to the insertion portions 14 of the side female coupling protrusion 12 formed in the fastening groove 10 on one side of another toy block 100. If it is desired that the two toy blocks 100 are separated from each other, at this time, one toy block 100 is taken and lifted up, so that the front male coupling protrusion 18 protruding from one side of one toy block 100 is easily separated from the insertion portions 14 of the side female coupling protrusion 12 on one side of another toy block 100 by means of the opening 16 formed on top end of the fastening groove 10. Accordingly, the two toy blocks 100 assembled to each other in the horizontal direction on the left and right sides can be easily separated from each other with the relatively small force.

So as to assemble the two toy blocks 100 up and down to each other, next, the locking protrusions 20 protruding from the four corners on top of the toy block 100 located down are locked onto inner corners of the open bottom of the toy block 100 located up, so that the two toy blocks 100 assembled up and down to each other can be firmly fixed to each other, without any deviation.

So as to provide various forms through the assembling of the clay block 50 to the toy block 100, further, the clay block 50 is bent to a desired form, and after that, the coupling protrusions 60 of one side connection cap 58 of the clay block 50 are fittedly coupled to the side female coupling protrusion 12 or the top female coupling protrusion 30 of the toy block 100, so that the clay block 50 can be fixedly assembled to the toy block 100. If necessary, further, the two clay blocks 50 are connected to each other by means of the connection caps 58, thereby providing the various forms.

Figure 11:
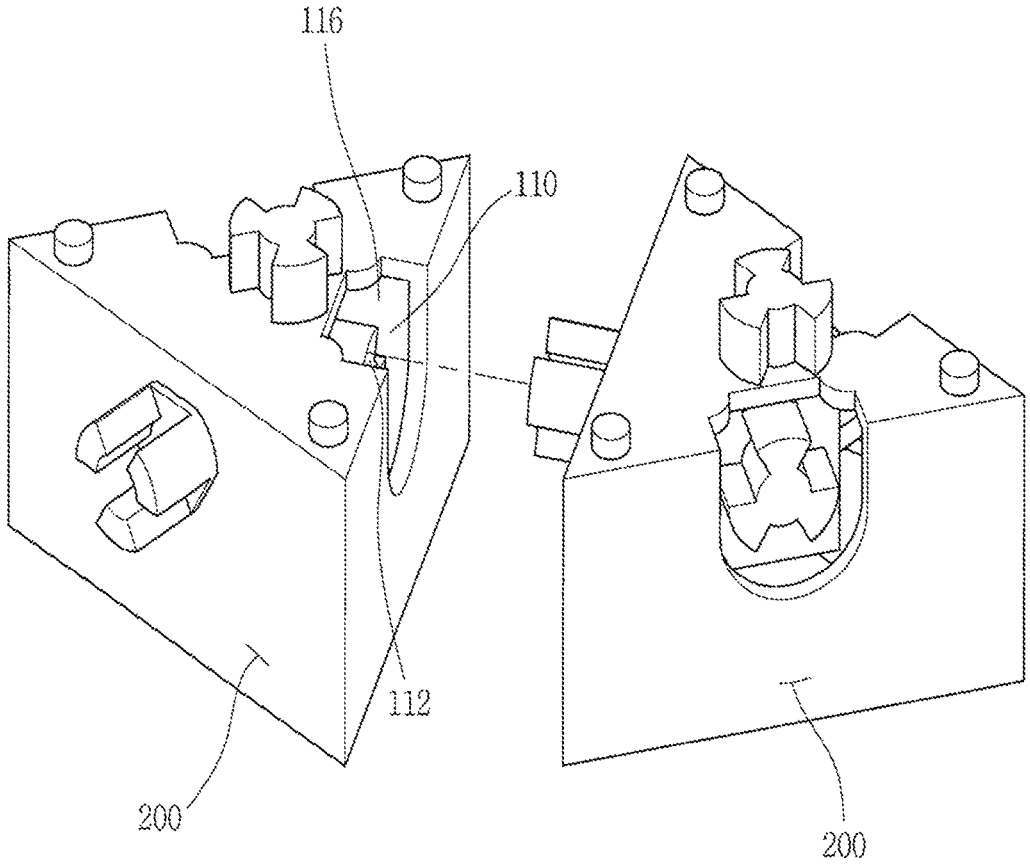
FIG. 11 is a perspective view showing another example of the toy blocks according to the present invention.

On the other hand, FIG. 11 is a perspective view showing another example of the toy block 100 according to the present invention.

As shown in FIG. 11, a toy block 200 has the same structure as the toy block 100 as mentioned above, and desirably, the toy block 200 is open on bottom thereof and includes a space portion formed in the open bottom thereof, fastening grooves 110 formed on side surfaces thereof, a side female coupling protrusion 112 formed in each fastening groove 110, and an opening 116 formed on top end of the fastening groove 110. The toy block 200 has a shape of a right triangle on the plane thereof, and in addition to the square and the right triangle, of course, it is obvious that the toy block 200 may have various shapes.

Figure 12:
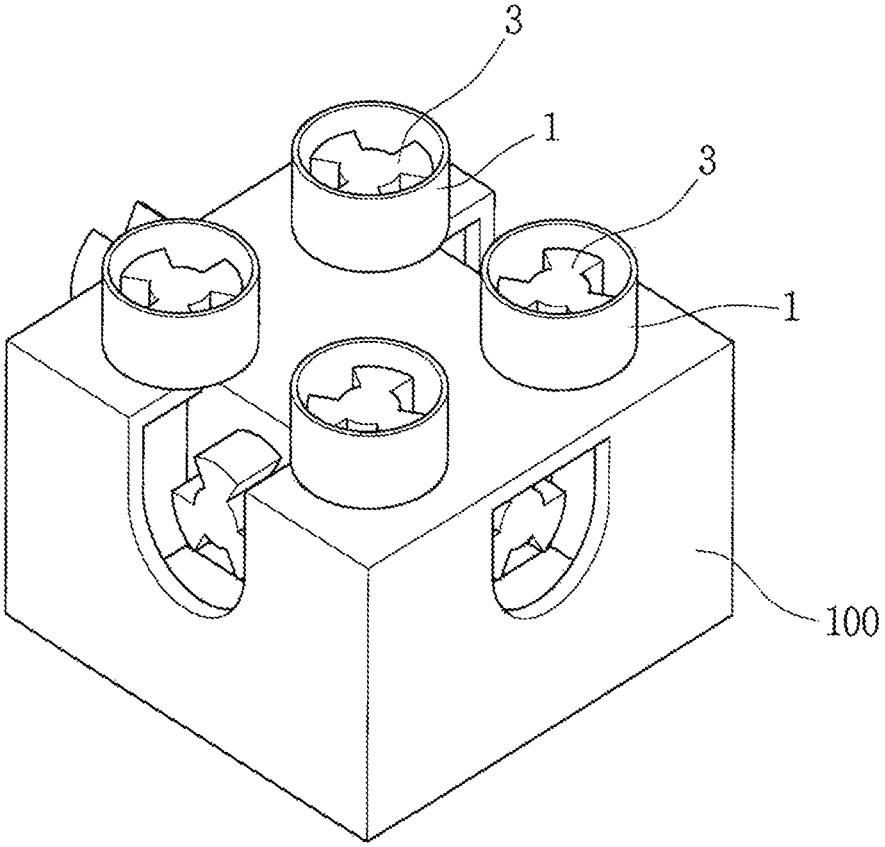
FIG. 12 is a perspective view showing yet another example of the toy blocks according to the present invention.

Further, as shown in FIG. 12, the toy block 100 has top hollow cylindrical protrusions 1 formed on top thereof, without any locking protrusions 20 and the top male coupling protrusions 30, and contact reinforcement concave-convex portions 3 protruding from the inner periphery of each top hollow cylindrical protrusion 1.

EXPLANATIONS ON REFERENCE NUMERALS

10: fastening groove
12: side female coupling protrusion
14: insertion portion
16: opening
20: coupling protrusion
30: top female coupling protrusion
32: insertion portion
50: clay block
52: metal wire
54: PVC coating material
56: cushion member
58: connection cap
60: coupling protrusion
100: toy block

What is claimed is:

1. An assembling toy block system comprising:

at least one or more polyhedral-shaped toy blocks (100); and clay blocks (50) configured to be coupled to the at least one or more toy blocks (100), wherein each toy block includes:

fastening grooves (10) formed on at least two lateral sides thereof, each fastening groove (10) having an open top end with an opening (16) accessible from an upper side of the toy block and a closed bottom end at the respective lateral sides of the toy block;

side female coupling protrusions (12) protruding from the fastening grooves (10) and each having at least one or more insertion portions (14) concavedly formed along an outer periphery thereof;

a front male coupling protrusion (18) protruding from a front surface thereof; and at least one or more top female coupling protrusions (30) protruding from a top surface of the toy block and each having at least one or more insertion portions (32) concavedly formed along an outer periphery thereof.

2. The assembling toy block system according to claim 1, wherein the clay blocks (50) are configured to be coupled to the at least one or more insertion portions (14) of the side female coupling protrusions (12), the at least one or more insertion portions (32) of the at least one or more top female coupling protrusions (30), or the front male coupling protrusion (18), wherein each clay block (50) comprises:

a metal wire (52) serving as a core and having rigidity so that the clay block (50) is to be kept in a bent shape;

a PVC coating material (54) covered on an outer periphery of the metal wire (52);

a cushion member (56) made of a silicone or resin material and covered on an outer periphery of the PVC coating material (54); and connection caps (58) made of an ABS material, coupled to two opposite terminal ends of the cushion member (56), and having coupling protrusions (60) protruding therefrom to allow the clay block (50) to be assembled to the toy block (100) or another clay block (50).

* * * * *